US007429273B2

(12) United States Patent
De Dominicis et al.

(10) Patent No.: US 7,429,273 B2
(45) Date of Patent: Sep. 30, 2008

(54) CARPET CLEANING COMPOSITION

(75) Inventors: Mattia De Dominicis, Mira (IT); Zefferino Righetto, Mira (IT)

(73) Assignee: Reckitt Benckiser N.V., Hoofddorp (NL)

( * ) Notice: Subject to any disclaimer, the term of this patent is extended or adjusted under 35 U.S.C. 154(b) by 160 days.

(21) Appl. No.: 10/531,109

(22) PCT Filed: Oct. 6, 2003

(86) PCT No.: PCT/GB03/04329

§ 371 (c)(1), (2), (4) Date: May 6, 2005

(87) PCT Pub. No.: WO2004/035725

PCT Pub. Date: Apr. 29, 2004

(65) Prior Publication Data

US 2006/0293203 A1 Dec. 28, 2006

(30) Foreign Application Priority Data

Oct. 12, 2002 (GB) ..... 0223848.3

(51) Int. Cl.

| | |
|---|---|
| ***B08B 3/04*** | (2006.01) |
| ***D06L 1/00*** | (2006.01) |
| ***C11D 1/12*** | (2006.01) |
| ***C11D 3/37*** | (2006.01) |
| ***C11D 17/08*** | (2006.01) |

(52) U.S. Cl. ..... 8/137; 510/278; 510/280; 510/295; 510/296; 510/297; 510/439; 134/39; 134/42; 8/137.5

(58) Field of Classification Search ..... 510/278, 510/280, 295, 296, 297, 439; 134/39, 42; 8/137, 137.5

See application file for complete search history.

(56) References Cited

U.S. PATENT DOCUMENTS

| | | | | |
|---|---|---|---|---|
| 3,936,448 | A | 2/1976 | Lamberti | 260/247.1 |
| 5,728,669 | A | 3/1998 | Tyerech | 510/280 |
| 5,946,769 | A | 9/1999 | Sprinkle | 15/321 |
| 6,239,166 | B1 * | 5/2001 | Black | 514/447 |
| 2003/0017955 | A1 * | 1/2003 | Forth et al. | 510/296 |
| 2003/0070692 | A1 * | 4/2003 | Smith et al. | 134/6 |

FOREIGN PATENT DOCUMENTS

| | | | |
|---|---|---|---|
| EP | 0518689 | | 12/1993 |
| GB | A-1261829 | | 1/1972 |
| GB | A-1379241 | | 1/1975 |
| GB | A-1387447 | | 3/1975 |
| GB | A-1389732 | | 4/1975 |
| GB | A-1398421 | | 6/1975 |
| GB | A-1398422 | | 6/1975 |
| GB | A-1425343 | | 2/1976 |
| GB | A-1439000 | | 6/1976 |
| GB | A-2244258 | | 11/1991 |
| GB | 2371307 | * | 7/2002 |
| GB | 2371307 A | | 7/2002 |
| NL | A-7205873 | | 11/1972 |
| WO | WO 89/04282 | | 5/1989 |
| WO | WO 98/47358 | | 10/1998 |
| WO | WO 00/55045 | | 9/2000 |
| WO | WO 01/36290 | | 5/2001 |
| WO | WO 01/83667 | | 11/2001 |
| WO | WO 01/85898 | | 11/2001 |
| WO | WO 02/16207 | | 2/2002 |
| WO | WO 02/16222 | | 2/2002 |

OTHER PUBLICATIONS

Combined Search and Examination Report from The Patent Office in Great Britain dated Apr. 17, 2003 for Application GB 0223848.3.
International Search Report dated Feb. 2, 2004 for Application PCT/GB03/04329.
International Preliminary Examination Report dated Apr. 1, 2004 for Application PCT/GB03/04329.
Written Opinion dated Jul. 12, 2004 for Application PCT/GB03/04329.

* cited by examiner

*Primary Examiner*—Brian P Mruk
(74) *Attorney, Agent, or Firm*—Norris McLaughlin & Marcus, PA

(57) ABSTRACT

The invention relates to a water-soluble product comprising a water-soluble polymer encasing a liquid carpet cleaning composition.

7 Claims, No Drawings

CARPET CLEANING COMPOSITION

This is an application filed under 35 USC 371 of PCT/GB03/04329.

The invention relates to a water-soluble product comprising a water-soluble polymer encasing a liquid carpet cleaning composition.

Carpet cleaning machines are becoming increasingly popular purchases for the home as the cost of such appliances falls. However, it is more common to hire these types of machines. The long periods between cleaning inevitably means that the accumulated dirt in the carpet requires a specialised carpet cleaning formulation.

The encasing polymer can be made of any water soluble or water dispersible polymer which can be sealed. Examples of water-soluble polymers are Poly(vinylalcohol) (PVOH), cellulose derivatives such as hydroxypropyl methyl cellulose (HPMC), gelatin, poly(vinylpyrrolidone), poly(acrylic acid) or an ester thereof or poly(maleic acid) or an ester thereof. Copolymers of any of these polymers may also be used.

The following are some advantages found in this invention:

A pre-dosed carpet cleaning composition.

The pre-dosed products prepared have high storage stability, up to 6 months at 50° C., even if the liquid contains water, at total levels of up to 50% wt.

The liquid compositions have higher soil removing performance compared to current Resolve™ for steam machine carpet cleaning liquid, taken as a reference.

The products of the invention need to be soluble in water and to dissolve in a short period, typically less than 5 minutes, without any stirring, to produce a product having low or no solid residue. A common feature of many carpet cleaning machines is the presence of a fine mesh filter preventing solid material from entering and damaging the internal mechanisms. Therefore, it is important that there are no/low solid residues in the reservoir so as to avoid any blockages.

We present as a feature of the invention a method of cleaning a soiled carpet the method comprising adding to the reservoir of a carpet cleaning machine a water-soluble product comprising a liquid carpet cleaning composition encased in a water-soluble polymer, adding water to the reservoir of the carpet cleaning machine prior to or after adding the product, and operating the carpet cleaning machine on the soiled carpet.

The pre-dosed composition can be added to the reservoir of the carpet cleaning machine either before or after the addition of water, preferably it is added prior to the addition of water.

The term "water-soluble" is taken to include water dispersible.

Preferably the liquid carpet cleaning composition comprises less than 5% w/w of free water, preferably less than 4, 3, 2 or 1 % w/w. Even more preferably the composition is anhydrous.

As used herein the term "free water" as defined in WO 02/16222, incorporated herein by reference. There is no direct correlation between the actual amount of water present in a composition and the amount of free water. Free water does not include water which is not available to the surrounding water-soluble polymer such as water held within a gelled matrix or water of solvation of any components present in the composition.

In order to determine the amount of free water present in a composition, a standard loss-on-drying determination test may be carried out. A sample of the composition, usually 10 g, is weighed, and then maintained at 60° C. for 3 hours under a partial vacuum of 200 mbar (20 kPa). The sample is then re-weighed, and the weight lost determined. In the present invention, the loss on drying of the composition is preferably less than 5 wt %, preferably less than 4, 3, 2 or 1 % w/w. Even more preferably the composition is anhydrous.

The actual amount of water present in the composition may be in excess of the amount of free water, as defined above, since the total water content includes water of solvation and water held within a gelled matrix. The total amount of water in the composition is, for example, more than 5, 10, 15, 20, 25 or 30% w/w. Total water levels of up to 50% w/w are preferred. The total water content may be less than 80% w/w, for example less than 70, 60, 50, 40, 30% w/w.

In an alternative embodiment the free water content may be greater than 5% w/w by the inclusion of sufficient components in the composition to raise the ionic strength of the composition this may be achieved by the use of suitable compositions, such as electrolytes, that prevent the water being available to the water-soluble polymer, see WO8904282 and EP0518689.

The product provides the consumer with a convenient form, which is pre-dosed, avoiding the need to dilute the product before it is added to the machine.

We have developed a pre-dosed product that contains a composition for carpet cleaning extraction machines. These compositions comprise at least one builder, one surfactant and a super wetting agent. Preferably these compositions additionally comprise up to 10% w/w of one or more of the following optional ingredients, antifoaming agent, solvent, fragrance, preservative, thickener, dye, bactericide and filler. Each optional ingredient may be present in an amount of up to 3% w/w.

The superwetting agent can be added to overcome the problem associated with-the high repellancy of carpet to water. This is primarily caused from two sources, the first being the amount of soiling which can accumulate on carpets and, secondly, the prevalence of stain repelling treatments, which are increasingly commonly applied to carpets either during manufacture or by the consumer. In this invention a super wetting agent is a special surfactant added at levels of below 10% w/w of the composition, preferably below 5% w/w, of the composition, that can, combined with any other surfactant present in the composition, is able to lower the surface tension of the final diluted liquid cleaning formulation to values below 28 mN/m, when 10 g is dissolved in 4 liters of water.

A problem associated with cleaning carpets is the high repellancy of the carpet to water. This is primarily caused from two sources, the first being the amount of soiling which can accumulate on carpets and, secondly, the prevalence of stain repelling treatments which are increasingly commonly applied to carpets either during manufacture or by the consumer. In this invention a "super wetting" agent is added to the composition and is a special surfactant added at levels of below 10% w/w of the composition, preferably below 9, 8, 7, 6 or 5% w/w, of the composition. It is preferred that at the levels described above, and in combination with any other surfactant present, it is able to lower the surface tension of the final diluted liquid cleaning formulation to value below 28 mN/m, when 10 g is dissolved in 4 liters of water.

We present as a further feature of the invention a water-soluble product comprising a carpet cleaning composition encased in a water-soluble polymer (ideally the carpet cleaning composition comprising at least one surfactant and at least one super wetting agent wherein the combined surface tension effect of the surfactant and the super wetting agent in the composition is capable of reducing the surface tension of water below 28 mN/m when 10 g of the composition is dissolved in 4 liters of water.

Preferably a product is used having from 1 to 25 g of liquid carpet cleaning composition per machine, ideally from 2 to 12 g, and preferably from 3 to 10 g.

Builders

The carpet cleaning composition comprises at least one builder active or a combination of builders from 1 to 90% w/w, preferably from 65 to 85% w/w. Preferably the builder is soluble or miscible with the liquid carpet cleaning composition.

Suitably carboxylate compounds are used and include the monomeric polycarboxylates, or their acid forms and polymeric polycarboxylic acids or their salts. Polymeric polycarboxylic acids are preferred for the reasons given above, in terms of protecting the water-soluble polymer.

The carboxylate builder can be monomeric or polymeric in type, monomeric polycarboxylates are generally preferred for reasons of cost and performance.

Suitable and preferred polymeric polycarboxylic acids are iminosuccinic acid or polyaspartic acid, mixtures thereof or their metal/amino salts. Examples of these polymers are Baypure CX 100/34 and Baypure DS 100/40 supplied from Bayer.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivates such as the carboxymethloxysuccinates described in GB-A-1,379,241, lactoxysuccinates described in GB-A-1,389,732, and aminosuccinates described in NL-A-7205873, and the oxypolycarboxylate materials such as 2-oxa-1,1,3-propane tricarboxylates described in GB-A-1,387,447.

Polycarboxylate containing four carboxy groups include oxydisuccinates disclosed in GB-A-1,261,829, 1,1,2,2-ethane tetracarboxylates, 1,1,3,3-propane tetracarboxylates and 1,1,2,3-propane tetracarobyxlates. Polycarboxylates containing sulfo substituents include the sulfosuccinate derivatives disclosed in GB-A-1,398,421, GB-A-1,398,422 and US-A-3,936448, and the sulfonated pyrolsed citrates described in GB-A-1,439,000.

Alicylic and heterocyclic polycarboxylates include cyclopentane-cis,cis,cis-tetracarboxylates, cyclopentadienide pentacarboxylates, 2,3,4,5,6-hexane—hexacarboxylates and carboxymethyl derivates of polyhydric alcohols such as sorbitol, mannitol and xylitol. Aromatic polycarboxylates include mellitic acid, pyromellitic acid and the phthalic acid derivatives disclosed in GB-A-1,425,343.

Of the above, the preferred polycarboxylates are hydroxycarboxylates containing up to three carboxy groups per molecule, more particularly citrates.

More preferred are the polymer builders, i.e. polymeric polycarboxylic acid, which are homo-polymers, copolymers and multiple polymers of acrylic, flourinated acrylic, sulfonated styrene, maleic anhydride, metacrylic, iso-butylene, styrene and ester monomers. Examples of these polymers are Acusol supplied from Rohm & Haas, Syntran supplied from Interpolymer and Versa and Alcosperse series supplied from Alco Chemical, a National Starch & Chemical Company.

Suitable builders are bicarbonates, sesquicarbonates, borates, phosphates, phosphonates, and mixtures of any of thereof.

Water-soluble phosphonate and phosphate builders are useful for this invention. Examples of phosphate builders are the alkali metal tripolyphosphates, sodium potassium and ammonium pyrophosphate, sodium and potassium and ammonium pyrophosphate, sodium and potassium orthophosphate sodium polymeta/phosphate in which the degree of polymerisation ranges from 6 to 21, and salts of phytic acid.

Specific examples of water-soluble phosphate builders are the alkali metal tripolyphosphates, sodium potassium and ammonium pyrophosphate, sodium and potassium and ammonium pyrophosphate, sodium and potassium orthophosphate, sodium polymeta/phosphate in which the degree of polymerization ranges from 6 to 21, and salts of phytic acid.

Examples of bicarbonate and carbonate builders are the alkaline earth and the alkali metal carbonates, including sodium carbonate and sesqui-carbonate and mixtures thereof. Other examples of carbonate type builders are the metal carboxy glycine and metal glycine carbonate.

Surfactants

Examples of surfactants considered in this invention are either anionic, non-ionic or cationic. Preferred total levels of surfactant are from 0.1 to 70% w/w, ideally from 1 to 30% wt and preferably between 5 to 20% w/w.

Examples of non-ionic surfactant are described in the formula $RO(CH2CH2O)_nH$ wherein R is a mixture of linear, even carbon-number hydrocarbon chains ranging from C12H25 to C16H33 and n represents the number of repeating units and is a number of from about 1 to about 12. Examples of other non-ionic surfactants include higher aliphatic primary alcohols containing about twelve to about 16 carbon atoms which are condensed with about three to thirteen moles of ethylene oxide.

Other examples of non-ionic surfactants include primary alcohol ethoxylates (available under the Neodol tradename from Shell Co.), such as C11 alkanol condensed with 9 moles of ethylene oxide (Neodol 1-9), C12-13 alkanol condensed with 6.5 moles ethylene oxide (Neodol 23-6.5), C12-13 alkanol with 9 moles of ethylene oxide (Neodol 23-9), C12-15 alkanol condensed with 7 or 3 moles ethylene oxide (Neodol 25-7 or Neodol 25-3), C14-15 alkanol condensed with 13 moles ethylene oxide (Neodol 45-13), C9-11 linear ethoxylated alcohol, averaging 2.5 moles of ethylene oxide per mole of alcohol (Neodol 91-2.5), and the like.

Other examples of non-ionic surfactants suitable for use in the present invention include ethylene oxide condensate products of secondary aliphatic alcohols containing 11 to 18 carbon atoms in a straight or branched chain configuration condensed with 5 to 30 moles of ethylene oxide. Examples of commercially available non-ionic detergents of the foregoing type are C11-15 secondary alkanol condensed with either 9 moles of ethylene oxide (Tergitol 15-S-9) or 12 moles of ethylene oxide (Tergitol 15-S-12) marketed by Union Carbide, a subsidiary of Dow Chemical.

Octylphenoxy polyethoxyethanol type non-ionic surfactants, for example, Triton X-100, as well as amine oxides can also be used as a non-ionic surfactant in the present invention.

Other examples of linear primary alcohol ethoxylates are available under the Tomadol tradename such as, for example, Tomadol 1-7, a C11 linear primary alcohol ethoxylate with 7 moles EO; Tomadol 25-7, a C12-C15 linear primary alcohol ethoxylate with 7 moles EO; Tomadol 45-7, a C14-C15 linear primary alcohol ethoxylate with 7 moles EO; and Tomadol 91-6, a C9-C11 linear alcohol ethoxylate with 6 moles EO.

Amine oxides can also be used as the non-ionic surfactant of the present invention. Exemplary useful amine oxide compounds may be defined as one or more of the following of the four general classes:

(1) Alkyl di (lower alkyl) amine oxides in which the alkyl group has about 6-24, and preferably 8-18 carbon atoms, and can be straight or branched chain, saturated or unsaturated. The lower alkyl groups include between 1 and 7 carbon atoms, but preferably each include 1-3 carbon atoms. Examples include octyl dimethyl amine oxide, lauryl dimethyl amine oxide, myristyl dimethyl amine oxide, and those in which the alkyl group is a mixture of different amine oxides, such as dimethyl cocoamine oxide, dimethyl (hydrogenated tallow) amine oxide, and myristyl/palmityl dimethyl amine oxide;

(2) Alkyl di (hydroxy lower alkyl) amine oxides in which the alkyl group has about 6-22, and preferably 8-18 carbon atoms, and can be straight or branched chain, saturated or unsaturated. Examples include bis-(2-hydroxyethyl) cocoamine oxide, bis(2-hydroxyethyl) tallowamine oxide; and bis-(2-hydroxyethyl) stearylamine oxide;

(3) Alkylamidopropyl di(lower alkyl) amine oxides in which the alkyl group has about 10-20, and preferably 12-16 carbon atoms, and can be straight or branched chain, saturated or unsaturated. Examples include cocoamidopropyl dimethyl amine oxide and tallowamidopropyl dimethyl amine oxide; and (4) Alkylmorpholine oxides in which the alkyl group has about 10-20, and preferably 12-16 carbon atoms, and can be straight or branched chain, saturated or unsaturated.

Useful anionic surfactant are frequently provided in a salt form, such as alkali metal salts, ammonium salts, amine salts, amino alcohol salts or magnesium salts. Contemplated as useful are one or more sulfate or sulfonate compounds including: alkyl sulfates, alkyl ether sulfates, alkylamidoether sulfates, alkyl benzene sulfates, alkyl benzene sulfonates, alkylaryl polyether sulfates, monoglyceride sulfates, alkylsulfonates, alkylamide sulfonates, alkylarylsulfonates, olefinsulfonates, paraffin sulfonates, alkyl sulfosuccinates, alkyl ether sulfosuccinates, alkylamide sulfosuccinates, alkyl sulfosuccinamate, alkyl sulfoacetates, alkyl carboxylates, alkyl phosphates, alkyl ether phosphates, acyl sarconsinates, acyl isethionates, and N-acyl taurates. Generally, the alkyl or acyl radical in these various compounds comprise a carbon chain containing 12 to 20 carbon atoms.

Other examples of anionic surfactants are also alkyl naphthalene sulfonate anionic surfactants of the formula:

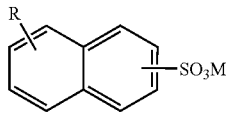

wherein R is a straight chain or branched alkyl chain having from about 1 to about 25 carbon atoms, saturated or unsaturated, and the longest linear portion of the alkyl chain is 15 carbon atoms or less on the average, M is a cation which makes the compound water soluble especially an alkali metal such as sodium or magnesium, ammonium or substituted ammonium cation.

Other examples are alkyl sarcosinate, sulfosuccinate and alkyl sulfate anionic surfactants of the formula

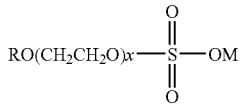

wherein R is a straight chain or branched alkyl chain having from about 8 to about 18 carbon atoms, saturated or unsaturated, and the longest linear portion of the alkyl chain is 15 carbon atoms or less on the average, M is a cation which makes the compound water soluble especially an alkali metal such as sodium or magnesium, ammonium or substituted ammonium cation, and x is from 0 to about 4. Most preferred are the non-ethoxylated C12-15 primary and secondary alkyl sulfates, especially sodium lauryl sulfate.

Most desirably, the anionic surfactant according to constituent is selected to be of a type that dries to a friable powder. This facilitates their removal from carpets and carpet fibres, such as by brushing or vacuuming.

The cationic surfactants of the invention are quaternary ammonium-salts which may be characterised by the general structural formula:

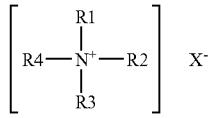

wherein R1, R2, R3 and R4 are independently selected from alkyl, aryl or alkylaryl substituent of from 1 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl and arylalkyl. The remaining substituents on the nitrogen atoms other than the above mentioned alkyl substituents are hydrocarbons usually containing no more than 12 carbon atoms. The substituents R1, R2, R3 and R4 may be straight-chained or may be branched, but are preferably straight-chained, and may include one or more amide, ether or ester linkages. The counterion X— are selected from halogens anions, saccharinate, alkyl and alkyl benzene sulfate, sulfonate and fatty acid.

Super Wetting Agents

The super wetting agents of this invention are present at levels of from 0.1 to 10% w/w, ideally 0.5 to 5% w/w, and are selected from silicone glycol copolymers and flurosurfactants. The silicone glycol copolymers are described by the following formula:

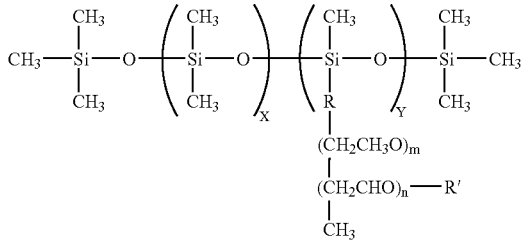

Where X, Y, m and n are whole number ranging from 0 to. 25. X is preferably between 0 to 10 and Y, m and n between 0 to 5. R and R' are straight chain or branched alkyl chain having from about 1 to 25 carbon atoms, saturated or unsaturated, and the longest linear portion of the alkyl chain is on average 15 carbon atoms or less. The fluorinated surfactant is described in the following formulae:

$$F(CF_2)_n—CH_2CH_2—S—CH_2CH_2—COOM$$

$$F(CF_2)_n—N(CH3)(CH2)_3—(CH_2CH_2O)_x—OSO_2M$$

$$CF_3(CF_2CF_2)_n(CFCF)_m—(CH_2CH_2O)_x—OPO_3M_2$$

Wherein n, m and x are integers having a value from 0 to 15; preferred values are between 1 and 12. M is a cation which is capable of making the compound water-soluble, especially an alkali metal such as sodium or magnesium or an ammonium or substituted ammonium cation.

The super wetting agents described are able to lower the surface tension in water at values below 25 mN/m at a concentration less than 0.1% w/v.

Antifoaming

Antifoaming agents are an important addition to carpet cleaning compositions of this invention, they are used at a level between 0.01 and 5% w/w. A very high foam level may not allow the carpet cleaning machine to function properly. Antifoaming agents are also considered important components of this invention. Examples are polydimethylsiloxanes, preferably in combination with hydrophobic silica.

Solvents:

Organic solvents should be water-miscible or water emulsionable. The organic solvent is found at levels of 0.01 to 60% w/v, more preferably between 0.1 to 30% w/w. The organic solvent constituent of the inventive compositions include one or more alcohols, glycols, acetates, ether acetates, glycol ethers and hydrocarbons. Exemplary alcohols useful in the compositions of the invention include C2-C8 primary and secondary alcohols which may be straight chained or branched. Exemplary alcohols include pentanol and hexanol. Exemplary glycol ethers include those glycol ethers having the general structure Ra—O—Rb—OH, wherein Ra is an alkoxy of 1 to 20 carbon atoms, or aryloxy of at least 6 carbon atoms, and Rb is an ether condensate of propylene glycol and/or ethylene glycol having from 1 to 10 glycol monomer units. Preferred are glycol ethers having 1 to 5 glycol monomer units.

By way of further non-limiting example specific organic constituents include propylene glycol methyl ether, dipropylene glycol methyl ether, tripropylene glycol methyl ether, propylene glycol n-propyl ether, ethylene glycol n-butyl ether, diethylene glycol n-butyl ether, diethylene glycol methyl ether, propylene glycol, ethylene glycol, isopropanol, ethanol, methanol, diethylene glycol monoethyl ether acetate and particularly useful is, propylene glycol phenyl ether, ethylene glycol hexyl ether, diethylene glycol hexyl ether. Examples of hydrocarbons solvents are linear and branched, satured and unsatured carbon chain with a number of carbon atoms from C4-C40, preferably from C6-C22.

Process Manufacturing:

In one embodiment, a compartment of water-soluble polymer is formed by moulding of a water-soluble polymer, especially one produced by injection moulding or blow moulding, such as described in WO 0136290. The compartment may have a wall thickness of, for example, greater than 100 μm, for example greater than 150 μm or greater than 200 μm, 300 μm, 500 μm, 750 μm or 1 mm. Preferably, the wall thickness is from 200 to 400 μm.

In an alternative embodiment the compartment may, for example, be formed of a film of the water-soluble polymer. The film may be a single film, or a laminated film as disclosed in GB-A-2,244,258. While a single film may have pinholes, the two or more layers in a laminate are unlikely to have pinholes that coincide.

The film may be produced by any process, for example by extrusion and blowing or by casting. The film may be unoriented, monoaxially oriented or biaxially oriented. If the layers in the film are oriented, they usually have the same orientation, although their planes of orientation may be different if desired.

The layers in a laminate may be the same or different. Thus they may each comprise the same polymer or a different polymer.

Examples of water-soluble polymers which may be used in a single layer film or in one or more layers of a laminate or which may be used for injection moulding or blow moulding are poly(vinyl alcohol) (PVOH), cellulose derivatives such as hydroxypropyl methyl cellulose (HPMC) and gelatin. An example of a preferred PVOH is ethoxylated PVOH. The PVOH may be partially or fully alcoholised or hydrolysed. For example it may be from 40 to 100%, preferably from 70 to 92%, more preferably about 88% or about 92%, alcoholised or hydrolysed. The degree of hydrolysis is known to influence the temperature at which the PVOH starts to dissolve in water. 88% hydrolysis corresponds to a film soluble in cold (ie room temperature) water, whereas 92% hydrolysis corresponds to a film soluble in warm water.

The thickness of the film used to produce the container, is preferably 40 to 300 μm, more preferably 80 to 200 μm, especially 100 to 160 μm, more especially 100 to 150 μm and most especially 120 to 150 μm.

In one embodiment, the film is vacuum formed or thermoformed into a compartment for the first composition, such as described in WO 0216207 For example, in a thermoforming process the film may be drawn down or blown down into a mould. Thus, for example, the film is heated to the thermoforming temperature using a thermoforming heater plate assembly, and then drawn down under vacuum or blown down under pressure into the mould. Plug-assisted thermoforming and pre-stretching the film, for example by blowing the film away from the mould before thermoforming, may, if desired, be used. One skilled in the art can choose an appropriate temperature, pressure or vacuum and dwell time to achieve an appropriate shape. The amount of vacuum or pressure and the thermoforming temperature used depend on the thickness and porosity of the film and on the polymer or mixture of polymers being used. Thermoforming of PVOH films is known and described in, for example, WO 00/55045 and WO 01/85898.

A suitable forming temperature for PVOH or ethoxylated PVOH is, for example, from 90 to 130° C., especially 90 to 120° C. A suitable forming pressure is, for example, 69 to 138 kPa (10 to 20 p.s.i.), especially 83 to 117 kPa (12 to 17 p.s.i.). A suitable forming vacuum is 0 to 4 kPa (0 to 40 mbar), especially 0 to 2 kPa (0 to 20 mbar). A suitable dwell time is, for example, 0.4 to 2.5 seconds, especially 2 to 2.5 seconds.

While desirably conditions chosen within the above ranges, it is possible to use one or more of these parameters outside the above ranges, although it may be necessary to compensate by changing the values of the other two parameters.

Once formed, the compartment may be filled with the liquid carpet cleaning composition. The compartment may be completely filled or only partially filled. The liquid composition may be thickened or gelled, if desired. More preferably, the composition is a transparent liquid, especially, a coloured, transparent liquid. The liquid composition may be non-aqueous or aqueous, although preferably comprising less than 5% free water as defined in WO 02/16222. The composition may have more than one phase. For example it may comprise an aqueous composition and a liquid composition that is immiscible with the aqueous composition. It may also comprise a liquid composition and a separate solid composition, for example in the form of a ball, pill or speckles.

The compartment is sealed with a sealing member and may be sealed together by any suitable means, for example by means of an adhesive or by heat sealing. Mechanical means is particularly appropriate if both have been prepared by injection moulding. Other methods of sealing include infra-red, radio frequency, ultrasonic, laser, solvent, vibration and spin welding. An adhesive such as an aqueous solution of PVOH may also be used. The seal desirably is water-soluble if the containers are water-soluble.

If heat sealing is used, a suitable sealing temperature is, for example, 120 to 195° C., for example 140 to 150° C. A suitable sealing pressure is, for example, from 250 to 600 kPa. Examples of sealing pressures are 276 to 552 kPa (40 to 80 p.s.i.), especially 345 to 483 kPa (50 to 70 p.s.i.) or 400 to 800 kPa (4 to 8 bar), especially 500 to 700 kPa (5 to 7 bar) depending on the heat sealing machine used. Suitable sealing dwell times are 0.4 to 2.5 seconds. One sealing member is made also from a water-soluble polymer, although not necessarily of the same water-soluble polymer as the compartment. The sealing member may be a film or a moulded piece.

One skilled in the art can use an appropriate temperature, pressure and dwell time to achieve a seal of the desired integrity. While desirably conditions are chosen within the above ranges, it is possible to use one or more of these parameters outside the above ranges, although it would might be necessary to compensate by changing the values of the other two parameters.

The containers may themselves be packaged in outer containers if desired, for example non-water soluble containers which are removed before the water-soluble containers are used.

The containers produced by the process of the present invention, may have a maximum dimension of 5 cm, excluding any flanges. For example, a container may have a length of 1 to 5 cm, especially 3.5 to 4.5 cm, a width of 1.5 to 3.5 cm, especially 2 to 3 cm, and a height of 1 to 2 cm, especially 1.25 to 1.75 cm.

Surface Tension Measurements:

The surface tension has been measured with a tensiometer, by the ring method. A platinum du Nuoy ring is immersed in 12 French degree water solution maintained at 20° C., containing a dissolved capsule of the invention. The ring is taken out slowly from the liquid. When the ring is near the air/liquid interface, it is balanced by a tensiometer to measure the force for the ring extraction. The maximum force versus area gained before breaking the liquid film formed is the surface tension of the liquid formula.

The lower the surface tension expressed in mN/m, the better the formula performance in terms of wettability on carpet surface.

A surface tension target value for the composition is below 28 mN/m.

Evaluation Test

The compositions have been evaluated in terms of storage stability, dissolution time in warm water (T=40° C.), remaining residue after dissolution and soil removal performance versus Resolve™ for steam machine taken as a reference of the machine carpet cleaner products.

Storage Stability Test:

Two containers for each condition were stored at 5° C., 25° C. and 50° C. in climatic cells. The change in the appearance of the container and the weight changes are monitored after 2 weeks, 1 month, 3 months and 6. A recording data table with the corresponding storage stability rating is reported below:

| Storage rating | Liquid appearance | Film appearance | Weight loss (g) |
|---|---|---|---|
| 0 | No separation | No difference from reference | No weight loss |
| 1 | No separation | Slightly humid and flexible | Less than 1% weight loss |
| 2 | Separation | Slightly humid and flexible | Less than 1% weight loss |
| 3 | No separation | Slightly humid and flexible | Weight loss between 1-5% |
| 4 | Separation | Slightly humid and flexible | Weight loss between 1-5% |
| 5 | No separation | Humid and flexible | More than 5% weight loss |
| 6 | Separation | Humid and flexible | More than 5% weight loss |
| 7 | No separation | Very humid and flexible | More than 5% weight loss |
| 8 | Separation | Very humid and flexible | More than 5% weight loss |
| 9 | — | The film is broken - | — |

The higher the rating number then the worse is the stability of the composition.

Dissolution and Residue Evaluation Test:

One container of 8 ml of composition is dissolved in a beaker containing ½ gallon of warm water (T=40° C.) with stirring and without stirring. The dissolution time as well as the remaining film residue quantity are recorded.

| Dissolution rating | Dissolution time | Film residue percentage |
|---|---|---|
| 0 | More than 30 minutes | 100% wt |
| 1 | Between 10-30 minutes | Between 20% wt |
| 2 | More than 10 minutes | More than 10% wt |
| 3 | Between 5 and 10 minutes | More than 10% wt |
| 4 | Between 5 and 10 minutes | Between 5 and 10% wt |
| 5 | Between 5 and 10 minutes | Between 5 and 10% wt |
| 6 | Less than 5 minutes | Between 5 and 10% wt |
| 7 | Less than 5 minutes | Less than 5% wt |

The higher the rating number then the better is the dissolution behaviour of the container.

Soil Removal Test:

This method has been designed for the evaluation of soil removal performance of extraction cleaner formulations.

The soil has the following composition:

| Soil components: | % by weight |
|---|---|
| Peat Moss | 47.7 |
| Cement | 21.4 |
| Kaolin clay | 8.0 |
| Silica | 8.0 |
| Red Iron oxide | 1.3 |
| Charcoal | 12.6 |
| Mineral oil | 1.0 |

A nylon carpet is used for the test.

The carpet is soiled with 5 grams of standard Soil. The soil is applied 1 gram once by strainer. The soiled carpet is then put with 4 kg of steel beads in a jar mill and stirred for 30 minutes at 56 rpm.

The containers are dissolved in warm tap water (T=40° C.). The Resolve for steam machine is diluted according to its labelling instructions.

Carpet is cleaned with appropriate machine/product using 4 wet strokes (dispensing solution) and 2 dry strokes (vacuuming up solution). Carpet swatches are placed in a dark room temperature chamber (25° C./50% RH) for 24 hours while they dry.

The cleaning performance is evaluated by measuring the carpet with a portable spectrophotometer before soiling, after soiling and after the cleaning process. The result is reported as soil removal percentage versus current Resolve steam machine liquid taking 100 as a reference.

EXAMPLES

The liquids are typically prepared by mixing all the components together in a suitable container to form a concentrate. The liquid concentrates are then filled in PVOH film pockets and heat sealed by using a Magic Vac Elite machine. The heat sealing process is carried out at 150° C. and 1 bar pressure. PVOH films used in the present invention are L712D obtained from Aquafilm ltd, UK) having a thickness of 120 μm and M8630 obtained from Chris Craft having a thickness of 76 μm Examples of compositions forming a part of the present invention are set forth below in Table 1 and 2; with various components identified in Table 3.

TABLE 1

| Components | Ex 1 % | Ex 2 % | Ex 3 % | Ex 4 % | Ex 5 % |
|---|---|---|---|---|---|
| EDTA | 71.98 | 71.98 | | | 71.63 |
| Trilon B | | | 37.41 | | |
| Trilon BS acid | | | 3.54 | | |
| Citric acid | 5.88 | 5.88 | | 0.63 | 5.63 |
| Petro 11 powder | 14.70 | 14.70 | 5.67 | 33.13 | 15.00 |
| Nonionic | | | 9.36 | 3.13 | |
| Syntran 1580 | | | 7.33 | | |
| Syntran 4015 | | | | 62.50 | |
| Dowanol PnP | | | 34.60 | | |
| Propylene glycol | 5.94 | 7.44 | | | |
| PEG 400 | | | | | 6.25 |
| Fragrance | 1.50 | | 1.85 | 0.63 | 1.50 |
| Antifoam | | | 0.23 | | |
| Water added* | 0.00 | 0.00 | 0.00 | 0.00 | 0.00 |
| Water content | 47.04 | 47.04 | 27.33 | 60.31 | 46.80 |

TABLE 2

| Components | Ex 6 % | Ex 7 % | Ex 8 % | Ex 9 % | Ex 10 % |
|---|---|---|---|---|---|
| Baypure CX100/34 | 37.50 | | 50.00 | 63.75 | 62.62 |
| Baypure DS100/40 | 8.22 | | 4.38 | 7.88 | 7.66 |
| Trilon B | 3.75 | 32.44 | | | |
| Trilon BS acid | | 3.07 | | | |
| Citric acid | | | 3.75 | 5.63 | 5.55 |
| Petro 11 powder | 15.62 | 4.92 | 18.75 | 15.00 | 14.14 |
| Genapol 26-L-60 | 2.06 | 8.13 | | | |
| Syntran 1580 | | 6.50 | | | |
| Propylene glycol | 31.25 | 13.15 | 21.63 | 6.25 | 6.13 |
| M-Pyrol | | 30.00 | | | |
| Fragrance | 1.60 | 1.60 | 1.50 | 1.50 | 1.43 |
| Antifoam | | 0.20 | | | |
| Aerosil 200 | | | | | 2.46 |
| Water added* | 0.00 | 0.00 | 0.00 | 0.00 | 0.00 |
| Water content | 31.34 | 23.93 | 35.63 | 46.80 | 47.38 |

*Some water is contained in some of the raw materials, such as CX 100/34, DS100/40, Syntran 1580, SE21 and Trilon B.

TABLE 3

| Component | Description of component |
|---|---|
| Baypure CX100/34 | Iminosuccinic sodium salt from Bayer |
| Baypure DS100/40 | Polyaspartic acid sodium salt from |
| Petro 11 powder | Alkyl naphthalene sulfonate from Witco |
| M-Pyrol | 1-methyl 2-pyrrolidinone from ISP |
| Aerosil 200 powd. | Amorphous silica from Degussa |
| Syntran 1580 | Acrylic copolymer from Interpolymer |
| Syntran 4015 | Acrylic copolymer from Interpolymer |
| Dowanol PnP | 1-Propoxy-2-propanol from Dow chem |
| PEG 400 | Polyethylene glycol from Basf |

Example Results

The products were tested in terms of storage stability, dissolution time and soil removal performance.

Results for Storage Stability Test:

8 ml gel caps have been used for storage stability.

| | Stability test rating | | | | | | | | | | | |
|---|---|---|---|---|---|---|---|---|---|---|---|---|
| | 2 weeks | | | 1 month | | | 3 months | | | 6 months | | |
| Product | 5° C. | 25° C. | 50° C. | 5° C. | 25° C. | 50° C. | 5° C. | 25° C. | 50° C. | 5° C. | 25° C. | 50° C. |
| Ex 1 | 1 | 1 | 1 | 1 | 1 | 3 | 1 | 3 | 3 | 2 | 5 | 5 |
| Ex 2 | 0 | 1 | 1 | 0 | 1 | 3 | 1 | 5 | 5 | 1 | 5 | 9 |
| Ex 3 | 3 | 9 | 9 | — | — | — | — | — | — | — | — | — |
| Ex 4 | 8 | 9 | 9 | — | — | — | — | — | — | — | — | — |
| Ex 5 | 2 | 5 | 5 | 2 | 9 | 9 | — | — | — | — | — | — |
| Ex 6 | 5 | 9 | 9 | — | — | — | — | — | — | — | — | — |
| Ex 7 | 9 | 9 | 9 | — | — | — | — | — | — | — | — | — |
| Ex 8 | 1 | 1 | 3 | 1 | 3 | 3 | 1 | 5 | 5 | 1 | 8 | 8 |
| Ex 9 | 1 | 1 | 1 | 1 | 1 | 1 | 1 | 3 | 3 | 1 | 3 | 3 |
| Ex 9 | 1 | 9 | 9 | — | — | — | — | — | — | — | — | — |
| Ex 10 | 1 | 1 | 1 | 1 | 1 | 2 | 1 | 1 | 2 | 1 | 1 | 2 |

Results for Dissolution Test:

| Product | Dissolution Test | | | |
|---|---|---|---|---|
| | with stirring | | without stirring | |
| Ex 9 | 6 | 3 | 5 | 2 |
| Ex 10 | 6 | — | 6 | — |

Results for Soil Removal Test:

The data are compared with the Resolve for steam machine liquid formulation taken as a reference of 100 of soil removal. The Resolve for steam machine product has been diluted 4 oz/gall according to its labelling instruction.

| Product | Soil removal test | |
|---|---|---|
| | 1 gel cap/gall | 2 gel caps/gall |
| Ex 1 | 89 | — |
| Ex 2 | 96 | — |
| Ex 8 | 61 | — |
| Ex 9 | 145 | 120 |
| Ex 10 | 135 | — |

The invention claimed is:

1. A method of cleaning a soiled carpet, the method comprising adding to the reservoir of a carpet cleaning machine a water soluble product comprising a liquid carpet cleaning composition which includes a super wetting agent encased in a water soluble polymer, adding water to the reservoir of the carpet cleaning machine prior to or after adding the water soluble product, and operating the carpet cleaning machine on the soiled carpet, wherein the liquid carpet cleaning composition encased in the water soluble polymer comprises at least one surfactant, at least one builder and at least one super wetting agent selected from silicone glycol copolymers and fluorosurfactants present in an amount of from 0.1 to 10% w/w, wherein a free water content of the liquid carpet cleaning composition is less than 5%.

2. The method according to claim 1 wherein the at least one super wetting agent is a silicone glycol copolymer selected from silicone glycol copolymers according to the following formula:

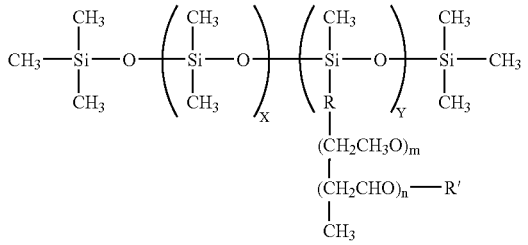

in which X, Y, m and n are independently a whole number ranging from 0 to 25; R and R' are straight chain or branched alkyl chain having from about 1 to 25 carbon atoms which may be saturated or unsaturated; and, the longest linear portion of the alkyl chain is on average 15 carbon atoms or less.

3. The method according to claim 2 wherein:

X is whole number between 0 to 10; and,

Y, m and n are each independently a whole number between 0 to 5.

4. The method according to claim 1 wherein the at least one super wetting agent is a fluorinated surfactant as described in one of the following formulae:

$$F(CF_2)_n—CH_2CH_2—S—CH_2CH_2—COOM$$

$$F(CF_2)_n—N(CH_3)(CH_2)_3—(CH_2CH_2O)_x—OSO_2M$$

$$CF_3(CF_2CF_2)_n(CFCF)_m—(CH_2CH_2O)_x—OPO_3M_2$$

in which n, m and x are integers each independently having a value from 0 to 15; and, M is a cation which is capable of making the compound water-soluble.

5. The method according to claim 4 in which n, m and x are integers each independently having a value between 1 and 12.

6. The method according to claim 4 in which M is a cation selected from alkali metal cation, an ammonium cation, or a substituted ammonium cation.

7. The method according to claim 1 in which the liquid carpet cleaning composition at a concentration in water of less than 0.1% w/v exhibits a surface tension below 25 mN/m.

* * * * *